US012546541B2

(12) United States Patent
Feng et al.

(10) Patent No.: US 12,546,541 B2
(45) Date of Patent: Feb. 10, 2026

(54) LIQUID-GAS PHASE-TRANSITION EVAPORATOR CONDUCIVE TO MOUNTING A CAPILLARY STRUCTURE IN PLACE

(71) Applicant: Long Victory Instruments Co., Ltd., Taoyuan (TW)

(72) Inventors: Chien-Chung Feng, Taoyuan (TW); Shen-Chun Wu, Taipei (TW)

(73) Assignee: LONG VICTORY INSTRUMENTS CO., LTD., Taoyuan (TW)

( * ) Notice: Subject to any disclaimer, the term of this patent is extended or adjusted under 35 U.S.C. 154(b) by 92 days.

(21) Appl. No.: 18/663,936

(22) Filed: May 14, 2024

(65) Prior Publication Data

US 2025/0354760 A1 Nov. 20, 2025

(51) Int. Cl.
*F28D 15/02* (2006.01)
*F28D 15/04* (2006.01)

(52) U.S. Cl.
CPC ..... *F28D 15/0266* (2013.01); *F28D 15/046* (2013.01)

(58) Field of Classification Search
CPC .... F28D 15/0266; F28D 15/046; F28D 15/00; F28D 15/04; F28D 15/0275; F28D 15/0233; F28D 15/043
USPC ..... 165/104.26
See application file for complete search history.

(56) References Cited

U.S. PATENT DOCUMENTS

| | | | | |
|---|---|---|---|---|
| 7,775,261 | B2 * | 8/2010 | Valenzuela | F28D 15/0233 165/104.21 |
| 8,807,203 | B2 * | 8/2014 | MacDonald | F28D 15/046 165/104.21 |
| 11,592,240 | B2 * | 2/2023 | Machida | F28D 15/0266 |
| 11,598,586 | B2 * | 3/2023 | Pichler | F28D 15/046 |
| 11,664,544 | B2 * | 5/2023 | Becker | H01M 50/24 429/120 |
| 11,874,067 | B2 * | 1/2024 | Liu | F28D 15/0233 |
| 12,025,382 | B2 * | 7/2024 | Wang | F28F 3/12 |

(Continued)

FOREIGN PATENT DOCUMENTS

| | | | | |
|---|---|---|---|---|
| CN | 100561108 C | * 11/2009 | | F28D 15/046 |
| CN | 106839844 A | * 6/2017 | | F28D 15/043 |

(Continued)

*Primary Examiner* — Jon T. Schermerhorn, Jr.
(74) *Attorney, Agent, or Firm* — MUNCY, GEISSLER, OLDS & LOWE, P.C.

(57) ABSTRACT

A liquid-gas phase-transition evaporator conducive to mounting a capillary structure in place includes: a casing having a top board, a bottom board, a lateral portion extending laterally to achieve enclosure, an enclosed space, a liquid inlet and a gas outlet; a plurality of positioning elements each tapering upward; and a capillary component having a plurality of receiving holes each opening downward, the receiving holes fitting around the plurality of positioning elements respectively, allowing the capillary component and the top board to be separated by a predetermined distance to form a gas chamber. Surfaces of the plurality of positioning elements are in contact with the capillary component through inner walls of the plurality of receiving holes respectively, allowing a slit to be formed between each of the receiving holes and a corresponding one of the positioning elements.

9 Claims, 9 Drawing Sheets

(56) References Cited

U.S. PATENT DOCUMENTS

| | | | | |
|---|---|---|---|---|
| 2004/0211549 | A1* | 10/2004 | Garner | F28D 15/046 431/325 |
| 2009/0321055 | A1* | 12/2009 | Wang | H01L 23/427 165/104.26 |
| 2013/0098592 | A1* | 4/2013 | Yang | H01L 23/427 165/185 |
| 2014/0311706 | A1* | 10/2014 | Tenzler | F28D 15/0233 165/61 |
| 2017/0292793 | A1* | 10/2017 | Sun | F28F 9/001 |
| 2022/0113093 | A1* | 4/2022 | Pichler | F28D 15/0233 |
| 2022/0128311 | A1* | 4/2022 | Chen | F28D 1/05383 |
| 2023/0204299 | A1* | 6/2023 | Feng | F28D 15/043 165/104.26 |
| 2024/0151478 | A1* | 5/2024 | Mu | H01L 23/427 |

FOREIGN PATENT DOCUMENTS

| | | | | |
|---|---|---|---|---|
| JP | 3210120 | U | * | 4/2017 |
| TW | I295366 | B | * | 4/2008 |
| TW | M539612 | U | * | 4/2017 |
| TW | I815257 | B | | 9/2023 |

* cited by examiner

LIQUID-GAS PHASE-TRANSITION EVAPORATOR CONDUCIVE TO MOUNTING A CAPILLARY STRUCTURE IN PLACE

BACKGROUND OF THE INVENTION

1. Field of the Invention

The present disclosure relates to technology of heat dissipation based on liquid-gas phase transition, and more particularly to a liquid-gas phase-transition evaporator conducive to mounting a capillary structure in place.

2. Description of Related Art

Taiwan patent 1815257 discloses a "liquid-in, gas-out" composite liquid-gas phase-transition heat sink. The heat sink has technical features as follows: a capillary structure disposed in a casing; the space in the casing is partitioned into an liquid-admitting chamber and a gas-discharging chamber; a liquid is guided into the liquid-admitting chamber and then delivered to reach the capillary structure from below; and the liquid is heated up and thus evaporated to flow into the gas-discharging chamber so as to be discharged via an outlet thereof. Therefore, the heat sink is effective in absorbing a lot of heat through the latent heat absorbed during liquid-gas phase transition.

The capillary structure of the aforesaid prior art is an integrally sintered copper powder or structure. Its working liquid is heated up and converted into vapor. However, it is difficult for the vapor to flow within the capillary structure; instead, the vapor has to move along a guiding structure of the capillary structure to flow laterally to the gas-discharging chamber. As a result, the aforesaid prior art is disadvantaged by low vapor dissipation efficiency.

As shown above, both the aforesaid "liquid-in, gas-out" evaporator and a conventional evaporator with a loop heat pipe (LHP) are disadvantaged by low vapor dissipation efficiency. Furthermore, its capillary structure is usually sintered together with the casing in order to be mounted in place, rather than directly positioned in place, and thus is inconvenient to mount in place.

BRIEF SUMMARY OF THE INVENTION

In view of the aforesaid drawbacks of the prior art, it is an objective of the disclosure to provide a liquid-gas phase-transition evaporator conducive to mounting a capillary structure in place, allowing a working gas produced through evaporation of a working liquid to conveniently and easily escape to a gas chamber.

To achieve the above and other objectives, the disclosure provides a liquid-gas phase-transition evaporator conducive to mounting a capillary structure in place, comprising: a casing having a top board, a bottom board, and a lateral portion extending laterally to achieve enclosure, allowing the top board, the bottom board, and the lateral portion to jointly define an enclosed space, the casing having a liquid inlet and a gas outlet, the liquid inlet admitting a liquid-state working liquid into the enclosed space, and the gas outlet discharging the gas-state working liquid from the enclosed space; a plurality of positioning elements spaced apart from each other by a predetermined distance, fixedly disposed on the bottom board, and located within the enclosed space, wherein the positioning elements each taper upward; and a capillary component being board-shaped, having a predetermined thickness, and having a plurality of receiving holes each opening downward, wherein the capillary component is disposed on the bottom board and located within the enclosed space to allow the plurality of receiving holes to fit around the plurality of positioning elements respectively, allowing the capillary component and the top board to be separated by a predetermined distance to form a gas chamber. The plurality of receiving holes substantially correspond in shape to the plurality of positioning elements, and the surfaces of the plurality of positioning elements are in contact with the capillary component through inner walls of the plurality of receiving holes respectively, allowing a slit to be formed between each of the receiving holes and a corresponding one of the positioning elements. The liquid inlet is blocked by the capillary component and thus is not in communication with the gas chamber, but the gas outlet is in communication with the gas chamber.

Therefore, a liquid-gas phase-transition evaporator of the disclosure is conducive to mounting a capillary structure in place, allowing a working gas produced through evaporation of a working liquid to conveniently and easily escape to a gas chamber.

DETAILED DESCRIPTION OF THE INVENTION

Figure 1:
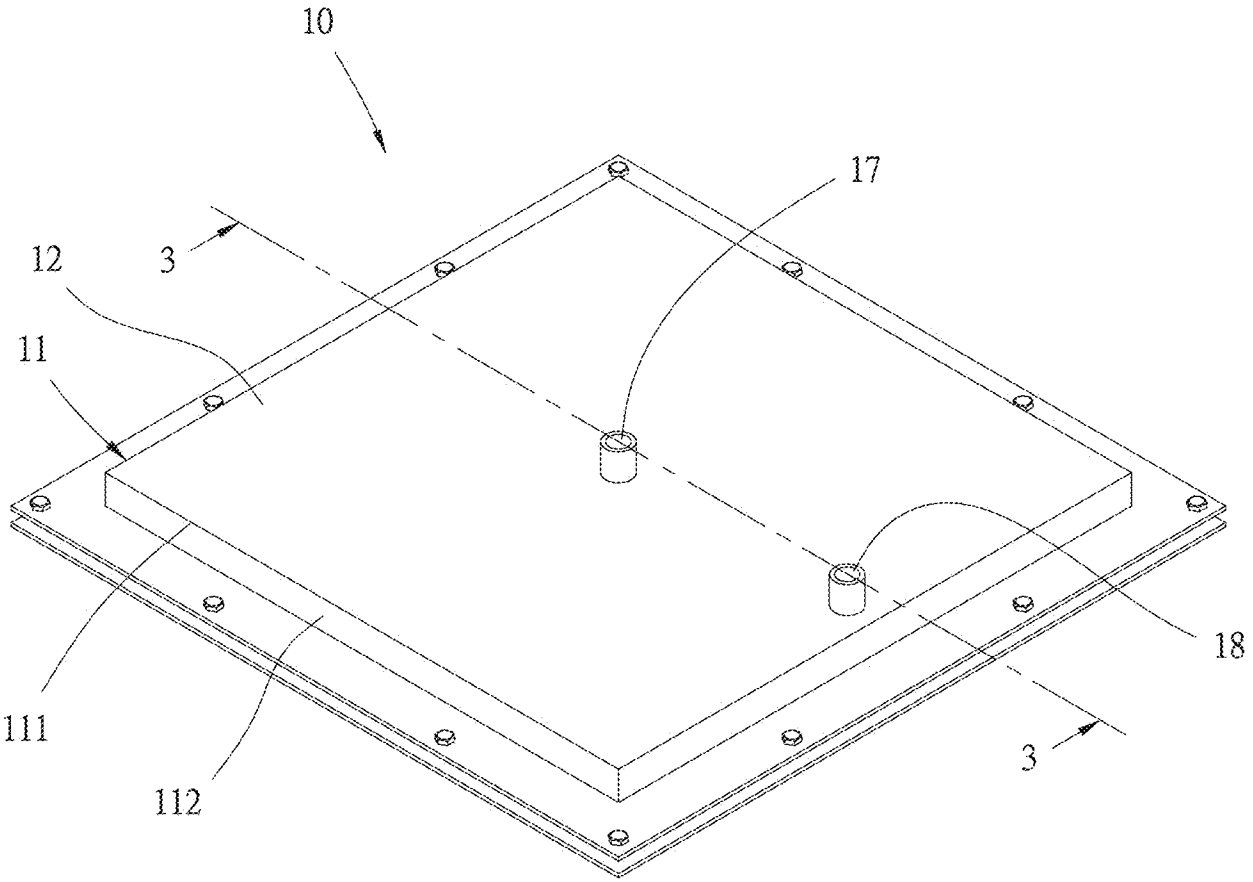
FIG. 1 is a perspective view of the first preferred embodiment of the disclosure.
Figure 2:
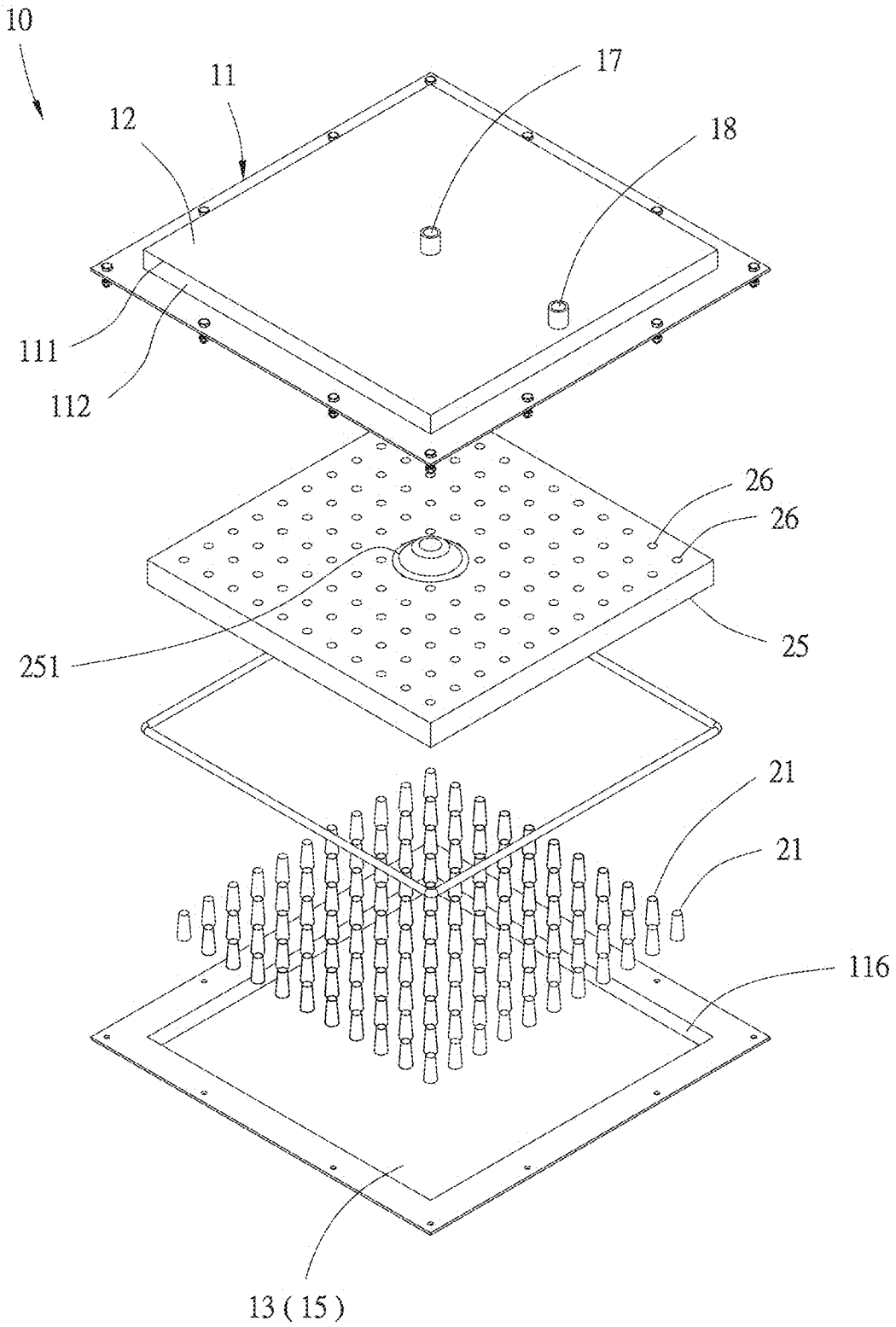
FIG. 2 is an exploded view of the first preferred embodiment of the disclosure.
Figure 3:
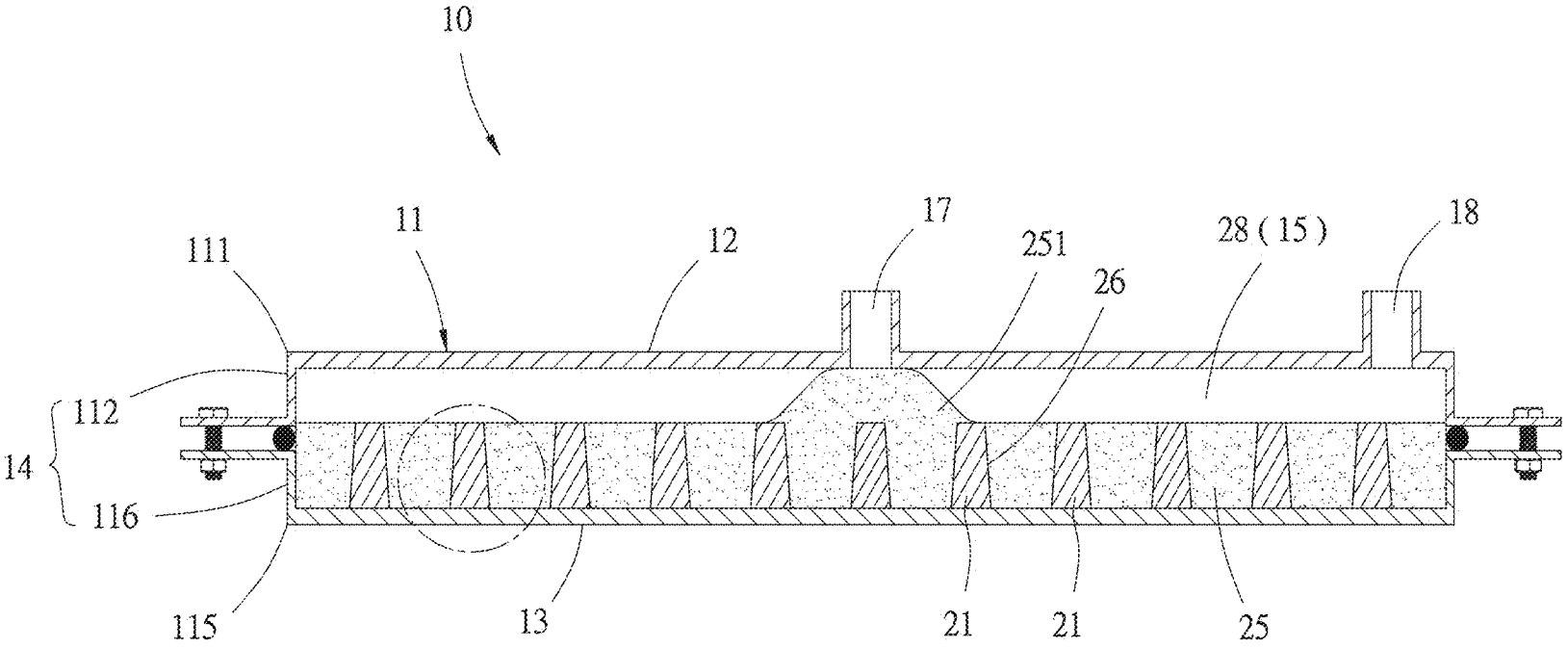
FIG. 3 is a cross-sectional view taken along line 3-3 in FIG. 1.
Figure 4:
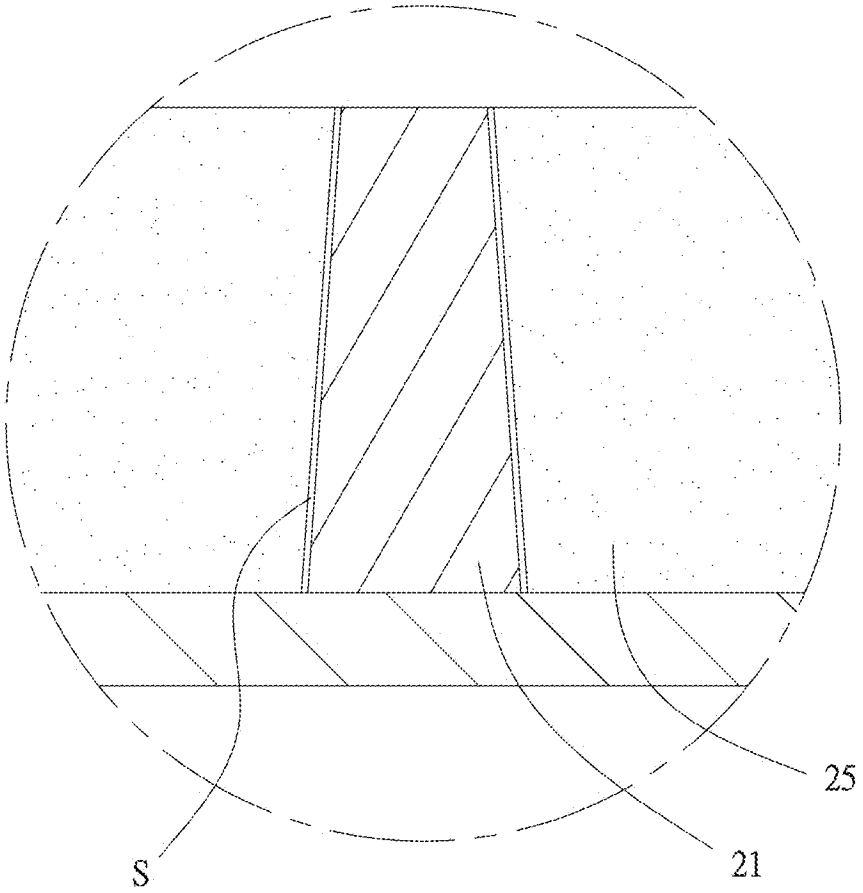
FIG. 4 is an enlarged view of a part of FIG. 3.

Technical features of the disclosure are herein illustrated with preferred embodiments, depicted with drawings, and described below.

As shown in FIG. 1 through FIG. 5, the first preferred embodiment of the disclosure provides a liquid-gas phase-transition evaporator 10 conducive to mounting a capillary structure in place. The liquid-gas phase-transition evaporator 10 conducive to mounting a capillary structure in place essentially comprises a casing 11, a plurality of positioning elements 21 and a capillary component 25.

The casing 11 has a top board 12, a bottom board 13, and a lateral portion 14 extending laterally to achieve enclosure. The top board 12, the bottom board 13, and the lateral portion 14 jointly define an enclosed space 15. The casing 11 has a liquid inlet 17 and a gas outlet 18. The liquid inlet 17 admits a liquid-state working liquid 99 (shown in FIG. 5) into the enclosed space 15. The gas outlet 18 discharges the gas-state working liquid 99 from the enclosed space 15. In this embodiment, the casing 11 comprises an upper casing 111 and a lower casing 115. The top board 12 is located at the upper casing 111. The bottom board 13 is located at the lower casing 115. The upper casing 111 has an upper sidewall 112. The lower casing 115 has a lower sidewall 116. The lateral portion 14 is formed from the upper sidewall 112 and the lower sidewall 116.

The plurality of positioning elements 21 are spaced apart from each other by a predetermined distance, fixedly disposed on the bottom board 13, and located within the enclosed space 15. The positioning elements 21 each taper upward. In the first embodiment, the positioning elements 21 are capillary structures made of metal or sintered copper powder or polymeric capillary structures. In the first embodiment, the positioning elements 21 are exemplified by solid copper posts.

The capillary component 25 is board-shaped and thus has a predetermined thickness. The capillary component 25 has a plurality of receiving holes 26 each opening downward. The capillary component 25 is disposed on the bottom board 13 and located within the enclosed space 15, allowing the plurality of receiving holes 26 to fit around the plurality of positioning elements 21 without covering the positioning elements 21 respectively. The capillary component 25 and the top board 12 are separated by a predetermined distance to form a gas chamber 28. In the first embodiment, the capillary component 25 is made of sintered copper powder and can be completely and conveniently mounted in place through direct placement.

The plurality of receiving holes 26 substantially correspond in shape to the plurality of positioning elements 21 respectively. The surfaces of the plurality of positioning elements 21 are in contact with the capillary component 25 through the inner walls of the plurality of receiving holes 26 respectively, allowing a slit S to be formed between each of the receiving holes 26 and a corresponding one of the positioning elements 21. The slit S is small in reality but is not drawn to scale in FIG. 4 for the sake of illustration.

The liquid inlet 17 is blocked by the capillary component 25 and thus is not in communication with the gas chamber 28, but the gas outlet 18 is in communication with the gas chamber 28.

In the first embodiment, the capillary component 25 extends upward to form an abutting element 251 made of the same material as the capillary component 25 and adapted to extend into the gas chamber 28 and lie centrally in the gas chamber 28. The abutting element 251 abuts against the top board 12. The liquid inlet 17 is disposed at the top board 12 and thus blocked by the abutting element 251 of the capillary component 25. The gas outlet 18 is also disposed at the top board 12.

Figure 6:
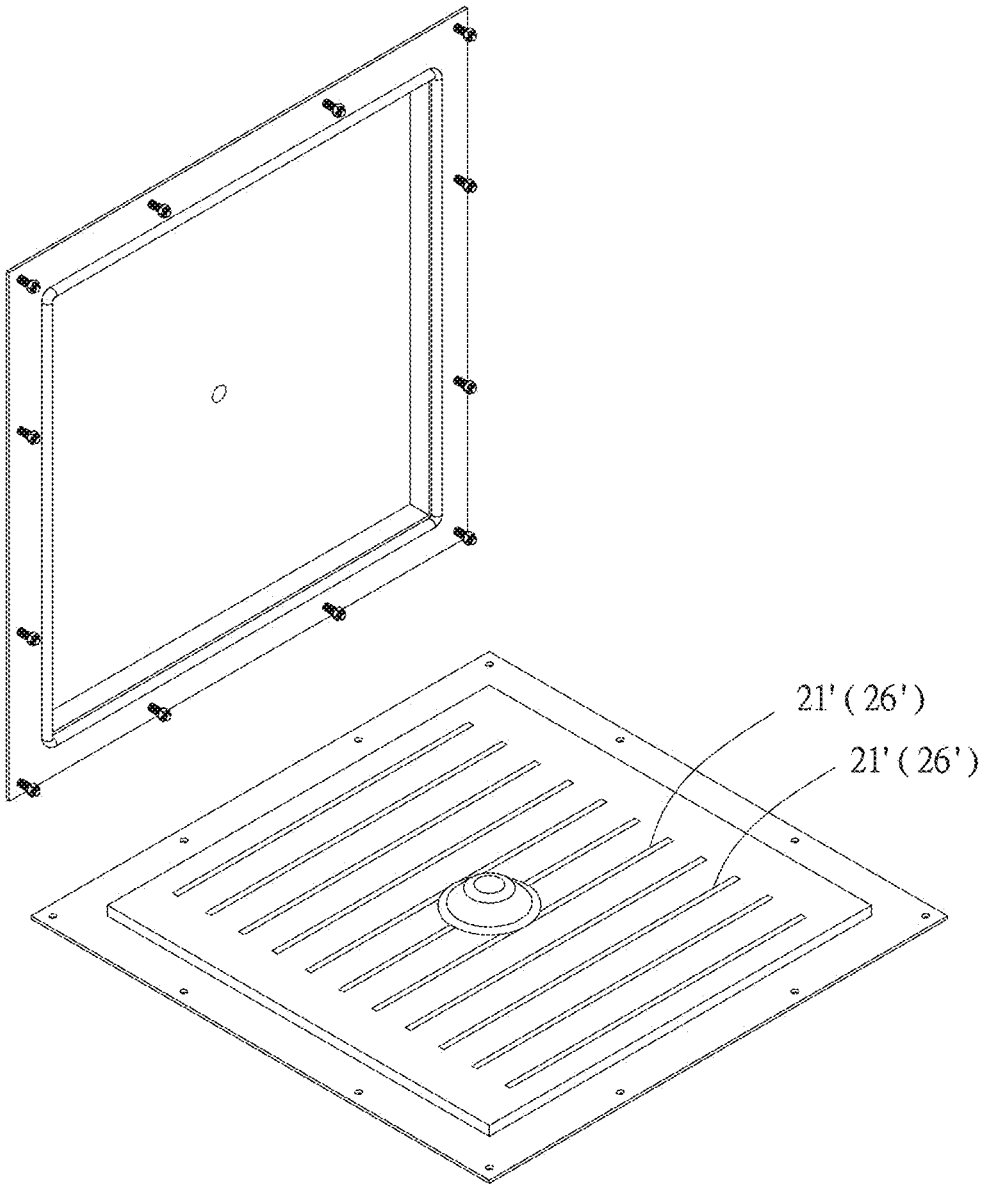
FIG. 6 is another schematic view of how to operate the first preferred embodiment of the disclosure.

As shown in FIG. 6, the plurality of positioning elements 21' are upright walls that extend laterally by a predetermined length but are not necessarily cylindrical posts, and the plurality of receiving holes 26' are elongated holes.

The structural features of the first embodiment are described above. The operation of the first embodiment is described below.

Figure 5:
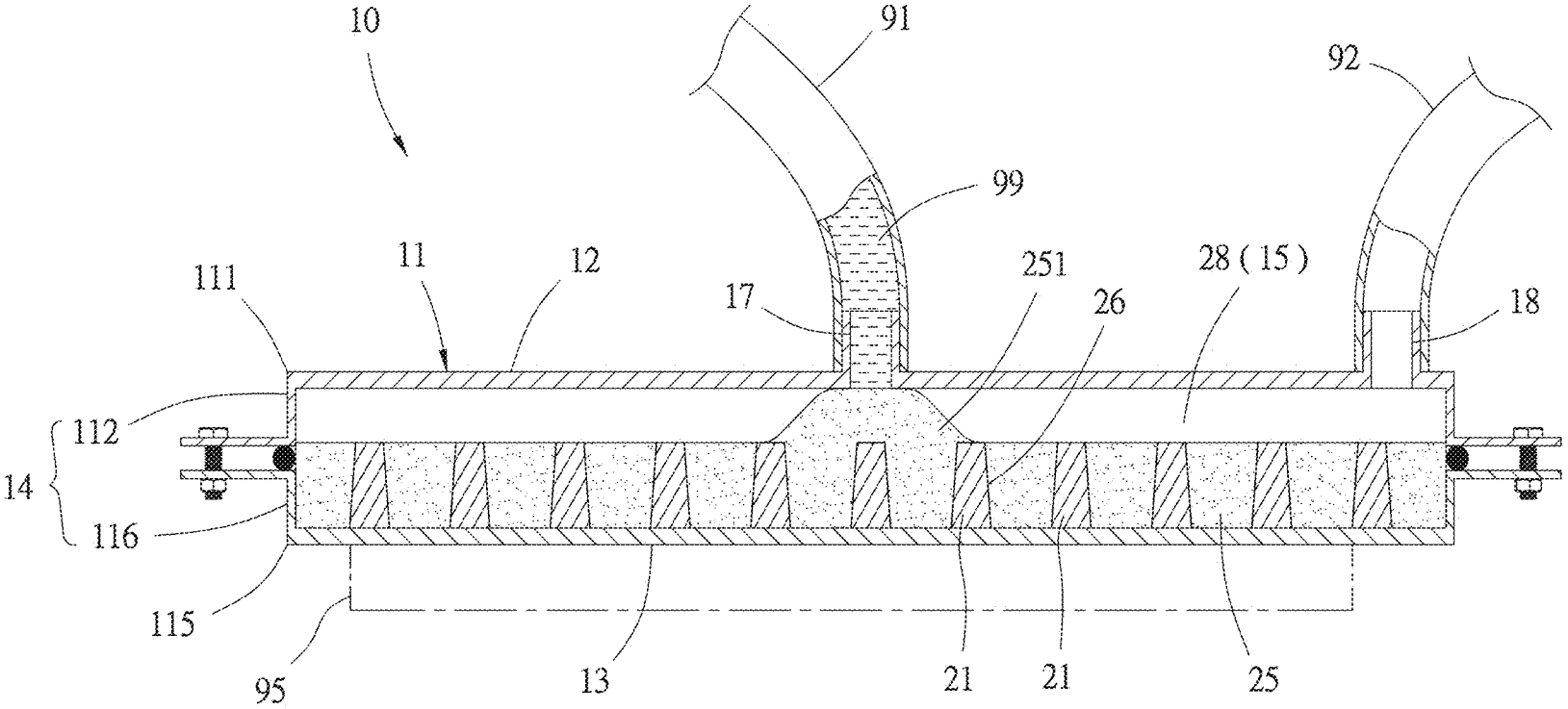
FIG. 5 is a schematic view of how to operate the first preferred embodiment of the disclosure.

As shown in FIG. 5, before the use of the first embodiment, a liquid pipe 91 and a gas pipe 92 are connected to the liquid inlet 17 and the gas outlet 18 respectively, and a heat source 95 (indicated by an imaginary line) is adhered to the bottom surface of the bottom board 13. During the use of the first embodiment, the liquid pipe 91 provides the working liquid 99 that enters the liquid inlet 17 and then adsorbs on the capillary component 25. The bottom board 13 absorbs heat generated from the heat source 95 and transfers the heat to the capillary component 25. Since the bottom of the capillary component 25 is heated up, the bottom of the capillary component 25 is hotter than the top of the capillary component 25. The liquid-state working liquid 99 that adsorbs on the bottom of the capillary component 25 is heated up first and evaporated to become gaseous to turn into the gas-state working liquid 99 (not shown). Although the gas-state working liquid 99 cannot directly penetrate the capillary component 25 to escape from the top of the capillary component 25 to reach the gas chamber 28, the gas-state working liquid 99 can enter the slit S between each of the receiving holes 26 and a corresponding one of the positioning elements 21, then move from the slits S to the tops of the positioning elements 21, enter the gas chamber 28, and finally flow to the gas pipe 92 via the gas outlet 18 before being discharged.

The capillary component 25 is mounted in place after the plurality of receiving holes 26 have fitted around the plurality of positioning elements 21; thus, a liquid-gas phase-transition evaporator of the disclosure is conducive to mounting a capillary structure in place. Furthermore, the slits S of the disclosure advantageously enable the gas-state working liquid 99 to easily escape to the gas chamber 28. By contrast, the prior art is disadvantaged by difficulties in the escape of a gas-state working liquid.

Figure 7:
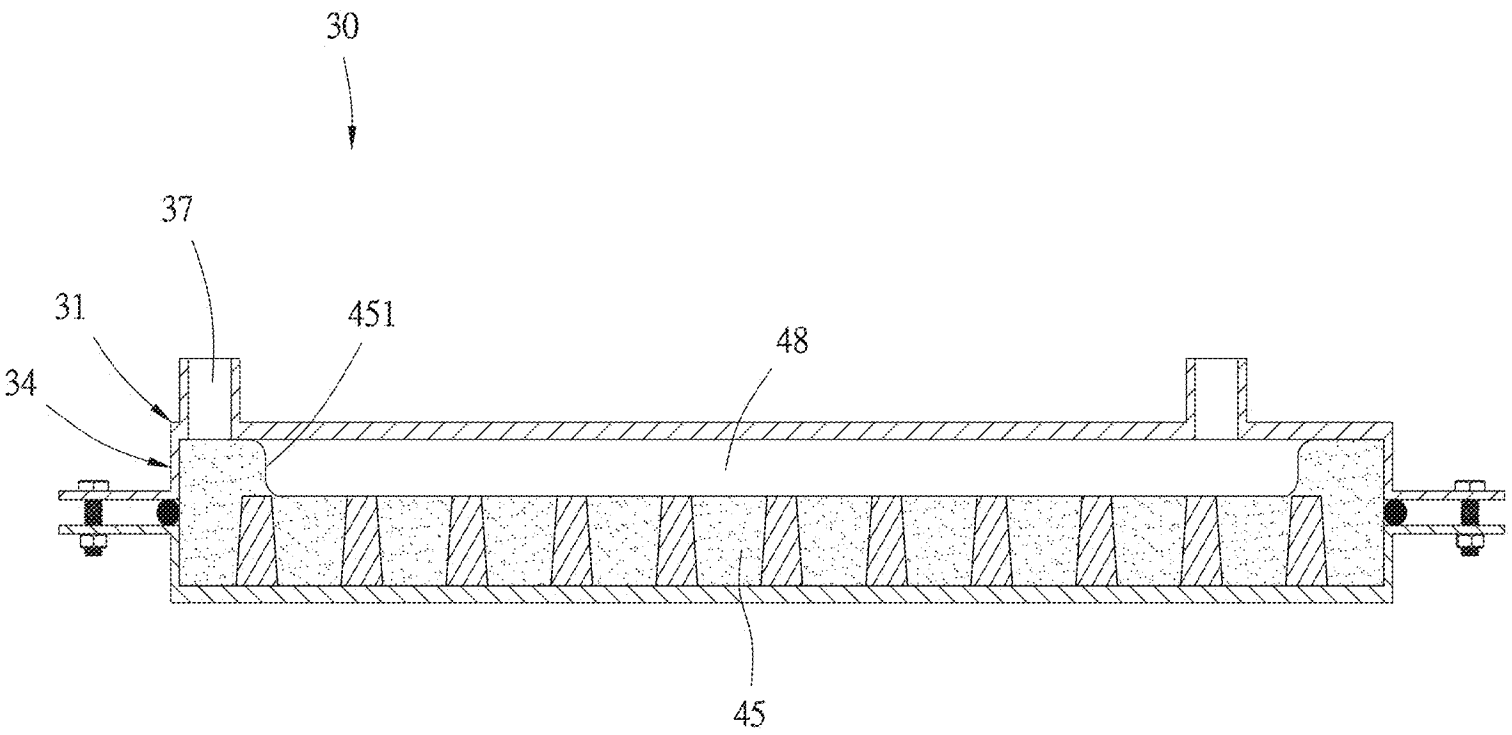
FIG. 7 is a cross-sectional view of the second preferred embodiment of the disclosure.

As shown in FIG. 7, the second preferred embodiment of the disclosure provides a liquid-gas phase-transition evaporator 30 conducive to mounting a capillary structure in place. The distinguishing technical features of the second preferred embodiment are described below.

The abutting element 451 extending from the capillary component 45 does not lie centrally in the gas chamber 48 but lies at one end of the gas chamber 48 and is in contact with the lateral portion 34 of the casing 31, and the position of the liquid inlet 37 varies with the position of the abutting element 451.

Therefore, the liquid-state working liquid 99 (shown in FIG. 5) that enters the liquid inlet 37 can also adsorb on the abutting element 451 to accomplish the aforesaid working state of the first embodiment, and thus the position of the liquid inlet 37 is changeable.

The other structural features and achievable advantages of the second embodiment are the same as those of the first embodiment and thus are, for the sake of brevity, not reiterated.

Figure 8:
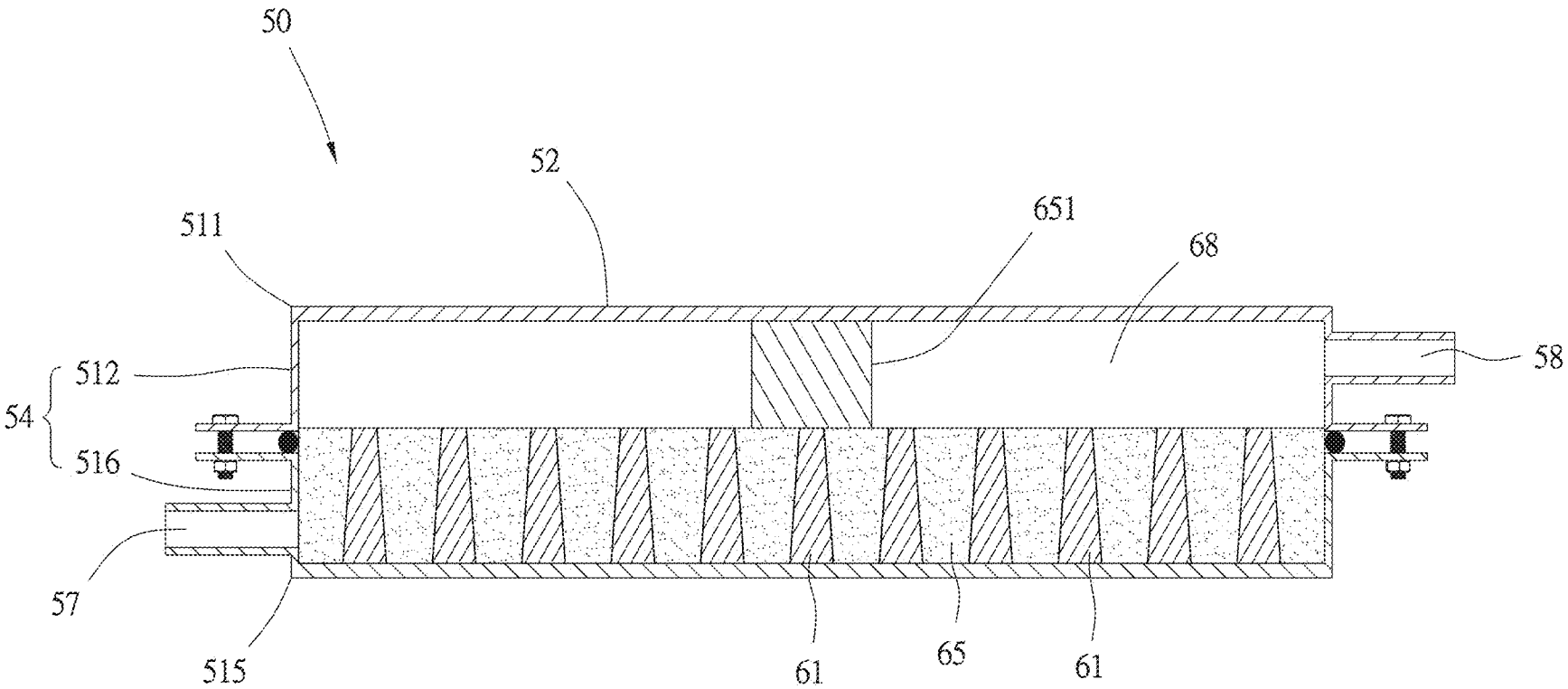
FIG. 8 is a cross-sectional view of the third preferred embodiment of the disclosure.

As shown in FIG. 8, the third preferred embodiment of the disclosure provides a liquid-gas phase-transition evaporator 50 conducive to mounting a capillary structure in place. The distinguishing technical features of the third preferred embodiment are described below.

The abutting element 651 does not extend from the capillary component 65 and is not made of the same material as the capillary component 65; instead, the abutting element 651 is made of copper, abuts against the top board 52 and the positioning elements 61, and lies in the gas chamber 68. The liquid inlet 57 is disposed at the lateral portion 54 or, specifically speaking, on the lower sidewall 516 of the lower casing 515. The gas outlet 58 is also disposed at the lateral portion 54 or, specifically speaking, on the upper sidewall 512 of the upper casing 511.

Therefore, the position of the liquid inlet 57 is changeable, and space above the top board 52 is available to other components, such as cooling fins (not shown).

Figure 9:
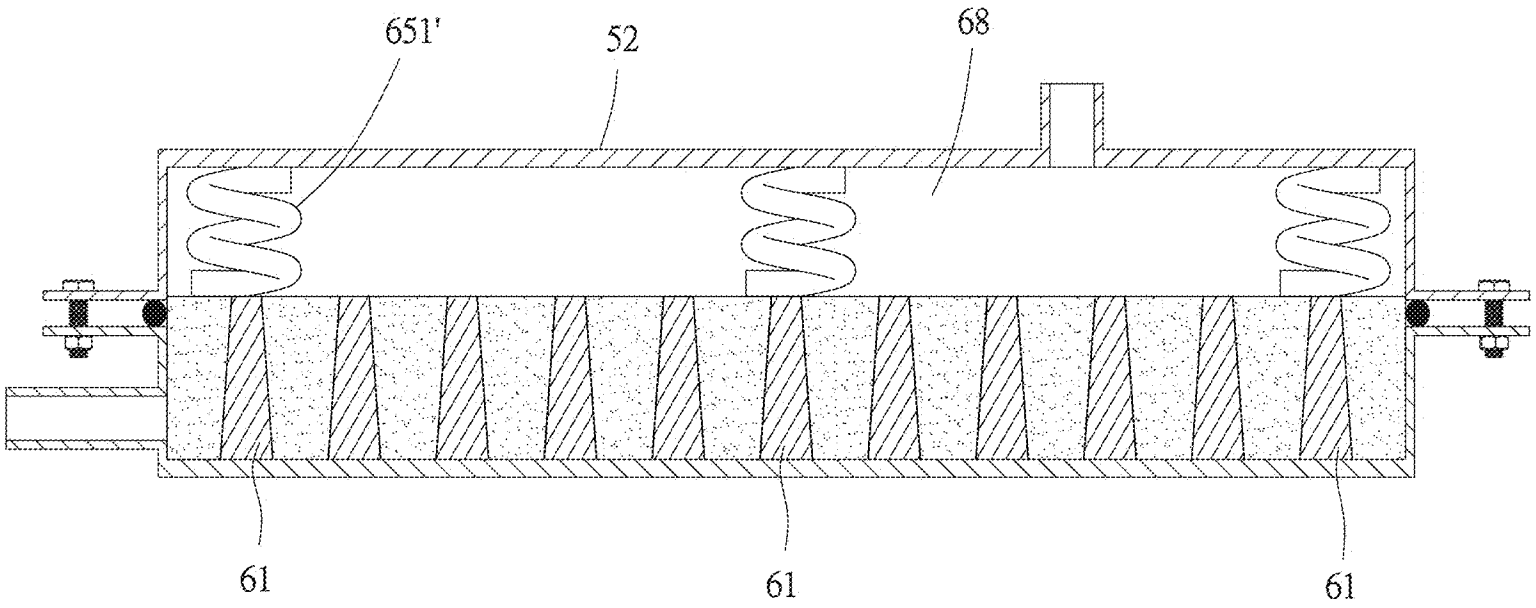
FIG. 9 is a schematic view of the third preferred embodiment of the disclosure.

As shown in FIG. 9, in the third embodiment, a spring 651' substitutes for the abutting element 651 and is provided in a plural number to abut against the top board 52 and the positioning elements 61 respectively and lie in the gas chamber 68.

The other structural features and achievable advantages of the third embodiment are the same as those of the first embodiment and thus are, for the sake of brevity, not reiterated.

When the positioning elements 21 and the capillary component 25 are capillary structures made of sintered copper powder, the density of the positioning elements 21 must be greater than or equal to the density of the capillary component 25. The larger the particles of copper powder are, the lower is the density of the positioning elements 21 and the capillary component 25 after the sintering process.

Furthermore, in some situations, the abutting element 251 can be dispensed with if the top board 12 need not be supported. Therefore, the abutting element 251 is not restrictive of the disclosure.

When the abutting element 651 is made of copper, the diameter of the abutting element 651 is equal to the diameter of the tops of the positioning elements below the abutting element 651, allowing the abutting element 651 and the positioning elements to be integrally formed, as inferred from FIG. 8. Thus, no additional diagram for depicting the abutting element 651 and the positioning elements is required.

The disclosure is disclosed above by embodiments. The embodiments are illustrative of the disclosure but shall not be interpreted as restrictive of the scope of the claims of the disclosure. Thus, all simple variations or equivalent implementation of the aforesaid embodiments according to the claims and detailed description of the disclosure shall be deemed falling within the scope of the claims of the disclosure.

What is claimed is:

1. A liquid-gas phase-transition evaporator conducive to mounting a capillary structure in place, comprising:

a casing having a top board, a bottom board, and a lateral portion extending laterally to achieve enclosure, allowing the top board, the bottom board, and the lateral portion to jointly define an enclosed space, the casing having a liquid inlet and a gas outlet, the liquid inlet admitting a liquid-state working liquid into the enclosed space, and the gas outlet discharging the gas-state working liquid from the enclosed space;

a plurality of positioning elements spaced apart from each other by a predetermined distance, fixedly disposed on the bottom board, and located within the enclosed space, wherein the positioning elements each taper upward; and a capillary component being board-shaped, having a predetermined thickness, and having a plurality of receiving holes each opening downward, wherein the capillary component is disposed on the bottom board and located within the enclosed space to allow the plurality of receiving holes to fit around the plurality of positioning elements respectively, allowing the capillary component and the top board to be separated by a predetermined distance to form a gas chamber, wherein the plurality of receiving holes substantially correspond in shape to the plurality of positioning elements, surfaces of the plurality of positioning elements are in contact with the capillary component through inner walls of the plurality of receiving holes respectively, allowing a slit to be formed between each of the receiving holes and a corresponding one of the positioning elements, wherein the liquid inlet is blocked by the capillary component and thus is not in communication with the gas chamber, but the gas outlet is in communication with the gas chamber.

2. The liquid-gas phase-transition evaporator conducive to mounting a capillary structure in place according to claim 1, wherein the casing comprises an upper casing and a lower casing, with the top board disposed at the upper casing, and the bottom board disposed at the lower casing, the upper casing having an upper sidewall, the lower casing having a lower sidewall, with the lateral portion formed from the upper sidewall and the lower sidewall, with the capillary component extending upward to form an abutting element extending into the gas chamber, allowing the abutting element to abut against the top board.

3. The liquid-gas phase-transition evaporator conducive to mounting a capillary structure in place according to claim 2, wherein the liquid inlet is disposed at the top board and thus blocked by the abutting element, and the gas outlet is disposed at the top board.

4. The liquid-gas phase-transition evaporator conducive to mounting a capillary structure in place according to claim 2, wherein the abutting element lies at an end of the gas chamber and is in contact with the lateral portion of the casing, and the liquid inlet is disposed at the lateral portion of the casing.

5. The liquid-gas phase-transition evaporator conducive to mounting a capillary structure in place according to claim 1, wherein the positioning elements are posts or upright walls extending laterally by a predetermined length.

6. The liquid-gas phase-transition evaporator conducive to mounting a capillary structure in place according to claim 1, wherein the positioning elements are capillary structures made of metal or sintered copper powder or polymeric capillary structures, the capillary component is a capillary structure made of sintered copper powder when the positioning elements are capillary structures made of sintered copper powder, and density of the positioning elements is greater than or equal to density of the capillary component.

7. The liquid-gas phase-transition evaporator conducive to mounting a capillary structure in place according to claim 1, wherein the capillary component does not cover the positioning elements when placed on the bottom board.

8. The liquid-gas phase-transition evaporator conducive to mounting a capillary structure in place according to claim 1, further comprising an abutting element abutting against the top board and at least one of the positioning elements and disposed in the gas chamber.

9. The liquid-gas phase-transition evaporator conducive to mounting a capillary structure in place according to claim 1, further comprising at least one spring abutting against the top board and at least one of the positioning elements and disposed in the gas chamber.

* * * * *